US005542759A

United States Patent [19]

Krivec

[11] Patent Number: 5,542,759

[45] Date of Patent: Aug. 6, 1996

[54] SHOCK ABSORBING DISCONNECT LATCH FOR DRAWER SLIDES

[75] Inventor: Bert Krivec, Brookfield, Wis.

[73] Assignee: Snap-on Technologies, Inc., Crystal Lake, Ill.

[21] Appl. No.: 429,671

[22] Filed: Apr. 27, 1995

[51] Int. Cl.[6] ..... A47B 88/00

[52] U.S. Cl. ..... 312/334.44; 312/333; 312/334.46; 312/334.47; 312/334.2; 384/18; 384/19; 384/21

[58] Field of Search ..... 312/334.44, 334.46, 312/334.47, 333, 334.2, 334.11; 292/10, 80; 384/18, 21, 19

[56] References Cited

U.S. PATENT DOCUMENTS

| | | | |
|---|---|---|---|
| 4,423,914 | 1/1984 | Vander Ley | 312/334.47 X |
| 4,441,772 | 4/1984 | Fielding et al. | 312/334.47 X |
| 4,473,262 | 9/1984 | Staye | 312/333 |
| 4,505,526 | 3/1985 | Leck . | |
| 4,549,773 | 10/1985 | Papp et al. | 312/334.47 X |
| 4,560,212 | 12/1985 | Papp et al. | 312/334.47 X |
| 4,953,990 | 9/1990 | Wojcik . | |
| 4,962,974 | 10/1990 | Fitz | 312/333 |
| 5,002,402 | 3/1991 | Parvin . | |
| 5,169,238 | 12/1992 | Schenk . | |
| 5,181,781 | 1/1993 | Wojcik . | |
| 5,181,782 | 1/1993 | Wojcik . | |
| 5,203,620 | 4/1993 | McLennan . | |
| 5,255,983 | 10/1993 | Parvin | 312/333 X |
| 5,261,737 | 11/1993 | Faust et al. . | |
| 5,281,021 | 1/1994 | Röck et al. . | |
| 5,292,198 | 3/1994 | Röck et al. . | |
| 5,316,389 | 5/1994 | Hoffman . | |
| 5,445,451 | 8/1995 | Harmony | 312/333 |
| 5,484,209 | 1/1996 | Weng | 384/18 |

FOREIGN PATENT DOCUMENTS

| | | | |
|---|---|---|---|
| 585037 | 3/1994 | European Pat. Off. | 312/334.44 |
| 1491612 | 11/1977 | United Kingdom | 312/334.46 |

*Primary Examiner*—Peter M. Cuomo
*Assistant Examiner*—Rodney B. White
*Attorney, Agent, or Firm*—Emrich & Dithmar

[57] ABSTRACT

A disconnect latch is provided for use with a drawer slide assembly of the type including an elongated drawer member and a stopper for limiting longitudinal travel of the elongated drawer member. The disconnect latch includes the unitarily formed combination of a lever, a mounting section for non-pivotally coupling the disconnect latch to the elongated drawer member, and a main body portion integral with the lever at one end thereof and with the mounting section at the opposite end thereof. The main body portion includes a stop surface for maintaining the elongated drawer member in a locked condition. A plurality of longitudinally spaced grooves is further included, each spanning the whole vertical height of the main body portion. The grooves facilitate the non-pivotal flexing of the disconnect latch so as to allow the stop surface to clear the locking member when downward pressure is applied to the lever, as well as to allow shock absorption during impact of the stop surface against the stopper.

27 Claims, 1 Drawing Sheet

SHOCK ABSORBING DISCONNECT LATCH FOR DRAWER SLIDES

BACKGROUND OF THE INVENTION

1. Field of the Invention

The present invention relates generally to the field of disconnect latches and, more particularly, to a high shock absorbing disconnect latch capable of reliably stopping drawer slide members from becoming unintentionally disconnected, while also providing ease of removal of the slide members and of the attached drawer upon demand.

2. Description of the Prior Art

Drawers are often mounted within cabinets using drawer slides, such as ball bearing slides and the like. Drawer slides permit easy access to the interior of the drawer. The slides maintain the drawer in a horizontal position regardless of how far the drawer is withdrawn from the cabinet. The most fundamental purpose of the drawer slide is to provide smooth, controlled and effortless movement, between the open and closed positions, of a drawer to which it is attached. The slide must therefore have provision for preventing accidental or unintended disengagement of the drawer when the drawer is in the fully extended or open position. A locking member incorporated on the slide assembly is generally used for this purpose. Occasionally however, a drawer must be removed from the cabinet, for example for repair or maintenance.

A disconnect latch facilitates removal of the drawer from the cabinet by disengaging the locking member. This is generally achieved by providing a latch connected to the drawer or, more specifically, to the slide member physically connected to the drawer which latch allows the unimpeded travel of the slide member, at least until a central raised portion (a stop lever) thereof is brought into contact with a corresponding stop found on an opposing channel member of the slide. Thus, as the drawer is opened, it travels unimpeded until the stop lever engages the stop, thereafter preventing any further forward travel. In order to remove the drawer, it is necessary for the user to disengage the stop lever by moving it to a position where it clears the stop. After accomplishing this, the drawer together with its attached slide members is free to be removed from the cabinet.

In early latch designs, the impact force from the engagement of each slide member with its corresponding stop led to a high incidence of mechanical failure of the latch and the opposing channel member. In addition, a sufficiently strong impact force against the stop by the longitudinally traveling latch often caused the rivet used to couple the latch to the slide member to be sheared off.

More recently, disconnect latches have been constructed which resolve some of the problems of the earlier latch designs. One such latch design is disclosed in U.S. Pat. No. 5,255,983 to Parvin showing a resilient unitary latch body provided with vertical slots that allow flexing (non-pivoting) of the latch to enable disengagement of the slide member for easy removal of the drawer using downward pressure on an associated lever, and also allow the absorption of shock energy and noise created when the slide member is stopped.

There is a need to further improve the shock absorbing and flexing properties of disconnect latches without compromising the strength and flexibility of the latch over long periods of use. The Parvin latch has only two slots, one of which is intended to be expanded and the other compressed during use, but neither one of which does both. While the Parvin patent suggests adding more slots it does not explain how to do so without compromising the small size, strength, ease of construction and shock absorbing properties of the latch.

SUMMARY OF THE INVENTION

It is a general object of the invention to provide a shock absorbing disconnect latch that is efficient in stopping the forward travel of a drawer while at the same time is extremely convenient for a user to access and disengage. Each drawer is to be provided with a disconnect latch on either side thereof, the levers of which can be easily flexed downwardly at the same time and in a comfortable fashion to facilitate removal of the drawer.

It is also an object of the present invention to provide a disconnect latch that operates ergonomically within the extremely narrow envelope defined by the width of the inner channel member of a slide, such as a ball bearing type slide.

It is also an object of the present invention to provide a disconnect latch that exhibits flexibility and high shock absorbing properties.

These and other features of the invention are attained by providing a disconnect latch for use with a drawer slide assembly of the type including an elongated drawer member and a stopper for limiting longitudinal travel of the elongated drawer member. The disconnect latch includes the unitarily formed combination of a lever, a mounting section for non-pivotally coupling the disconnect latch to the elongated drawer member, and a main body portion integral with the lever at one end thereof and with the mounting section at the opposite end thereof. The main body portion includes a stop surface for maintaining the elongated drawer member in a locked condition. A plurality of longitudinally spaced grooves are further included, each spanning the whole vertical height of the main body portion. The grooves facilitate the non-pivotal flexing of the disconnect latch to allow the stop surface to clear the locking member when downward pressure is applied to the lever, as well as to allow shock absorption during impact of the stop surface against the stopper.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE PREFERRED EMBODIMENTS

Figures 1, 2, 3, 4, 5, 6, 7, 8, 9, 10:
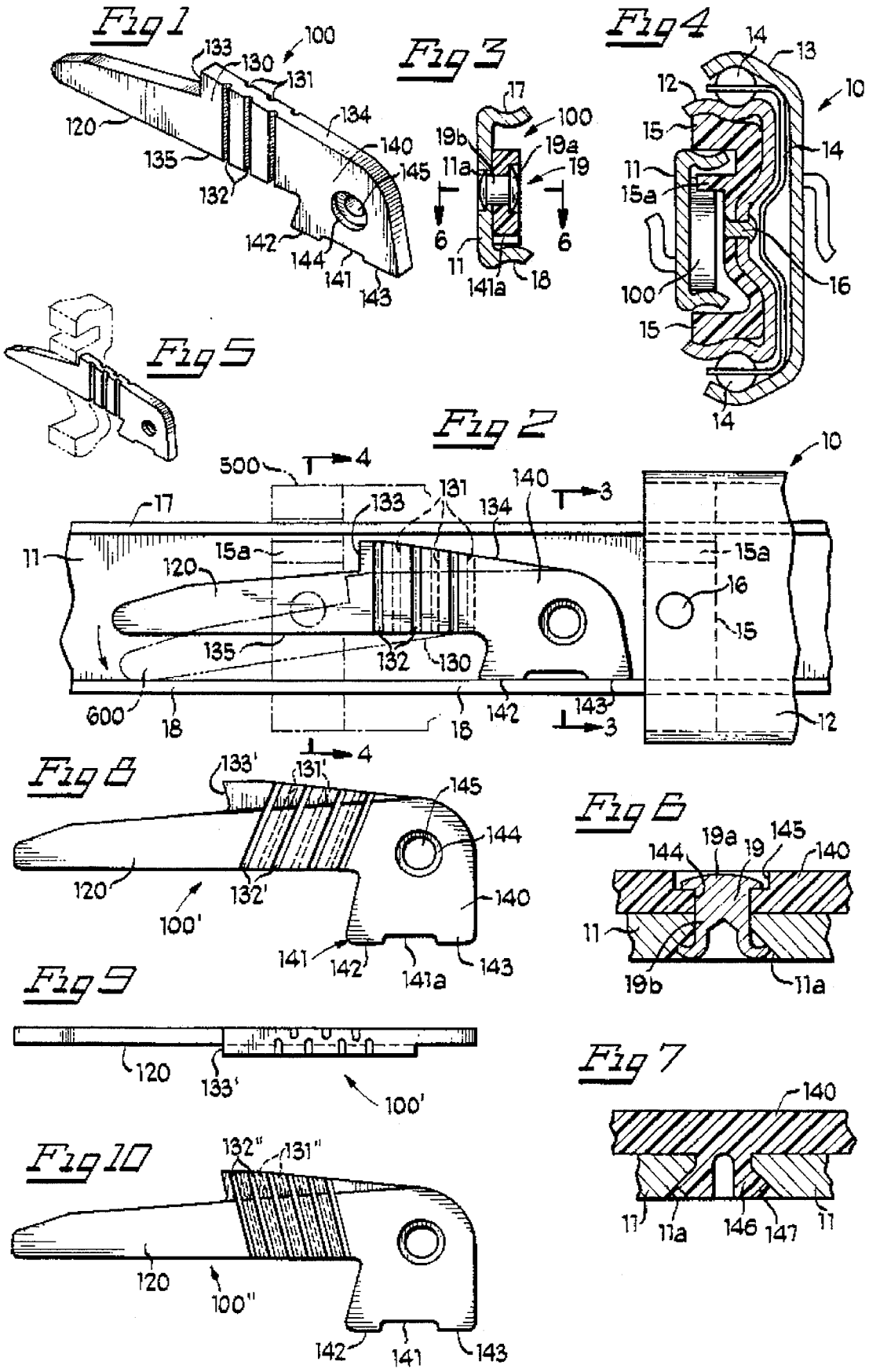
FIG. 1 is a perspective view of a shock absorbing disconnect latch constructed in accordance with and embodying the features of the present invention.
FIG. 2 is a side elevation view of the latch of FIG. 1 fitted to a drawer slide member, with a flexed position of the lever and a stopped position of the slide both shown in phantom.
FIG. 3 is a view in vertical section taken generally along line 3—3 in FIG. 2.
FIG. 4 is a view in vertical section taken generally along line 4—4 in FIG. 2, with the latch in its normal or non-depressed position with respect to the drawer stop portion of the drawer side.
FIG. 5 is a reduced perspective view of the latch of FIG. 1 in combination with the drawer stop, with the latter shown in phantom.
FIG. 6 is a enlarged view in horizontal section taken generally along line 6—6 of FIG. 3, showing the counter-bored slide connecting section of the latch connected to the drawer slide member by a rivet.
FIG. 7 is a view similar to that in FIG. 6, but showing the latch provided with an extruded post for snap-fit connection to the drawer slide member.
FIG. 8 is a side elevation view of a disconnect latch constructed in accordance with a second preferred embodiment of the present invention, having grooves similar to those of FIG. 1 but tilted slightly in the direction of the non-pivoting rivet end of the latch.
FIG. 9 is a top plan view of the latch of FIG. 8, more clearly showing the thickness of the top portion of the latch relative to the rest of the latch body.
FIG. 10 is a view similar to that of FIG. 8 of another embodiment of the invention, with the latch provided with a greater number of grooves, all of which are tilted in a direction opposite that of the grooves in FIG. 8.

Referring to FIG. 1, there is illustrated a shock absorbing disconnect latch, generally designated by the numeral 100, constructed in accordance with and embodying the features of the present invention.

The latch 100 is of unitary construction, preferably made from a rubber or a plastic elastomer material, such as polyurethane or the like, and is generally comprised of three sections integrally formed. The three sections are a lever 120, a flexural main body 130 including groups of grooves 131, 132, respectively, and a non-pivoting slide-connecting portion 140.

Referring to FIGS. 2–4, the latch 100 is preferably secured to a drawer member 11 of a drawer slide assembly 10. In the illustrative embodiment, the drawer slide assembly 10 is a ball bearing type slide of conventional three-part construction, including the drawer member 11 fixed to an associated drawer (not shown), an intermediate slider member 12 and a cabinet member 13 fixed to an associated cabinet (not shown). The intermediate slider member 12 is coupled on one side thereof to the cabinet member 13 by way of a first ball bearing race 14 and to the drawer member 11 by way of a second ball bearing race (not shown) to facilitate slidable engagement therebetween, all in a known manner. To restrict the longitudinal travel of the drawer member 11 and hence the drawer to which it is fixed, when the drawer is pulled to its fully extended position, a stopper 15 is provided at the end of the second ball bearing race closest to the front end of the drawer. The stopper 15 is secured to the side wall of the intermediate slider member 12 by a countersink rivet 16, or the like, in a manner well known in the art. The stopper 15 includes a protruding stopping post **15*a* intended to engage the latch 100 coupled to the drawer member 11** to prevent the inadvertent or unintended travel of the drawer beyond the fully extended position, as will be described below.

The drawer member 11 includes top and bottom flanges 17 and 18 spaced apart a distance which is very slightly greater than the width or height of the disconnect latch 100, as shown in FIG. 2.

Referring back to FIG. 1, the lever 120 extends horizontally parallel to the flanges 17 and 18. The flexural main body 130 includes a stop surface 133 formed generally normal to the longitudinal axis of the lever 120, having a rearwardly downwardly angled top surface 134 joining the main body 130 to the non-pivoting slide-connecting portion 140. The groups of grooves 131, 132 extend vertically along the whole height of the main body 130, respectively along opposite sides thereof, with the grooves of each group being substantially parallel and spaced a predetermined fixed distance apart. In the illustrative embodiment of FIGS. 1 and 2 the latch 100 is provided with three grooves 131 and three grooves 132. The grooves 131 are longitudinally offset rearwardly from the grooves 132 one-half the predetermined spacing distance in a staggered manner. The base or root surfaces of the grooves 131, 132 are generally arcuate to prevent against their shearing or tearing under the stress of extended or continuous flexural use.

As will be explained more fully below, grooves 131, 132 expand and/or compress to facilitate depression of the lever 120 in the direction of the arrow in FIG. 2, and to absorb shock when the stop surface 133 comes into contact with the stopper 15. The amount of deflection and shock absorption yielded is a function of the thickness and hardness of the latch material and of the depth, size, number and position of the grooves 131, 132. Consequently, the latch 100 can be constructed with appropriate deflection and shock absorbing properties for the particular environment in which it is to be used.

The slide-connecting portion 140 comprises an upstanding wall having a bottom surface 141 provided with a central recess **141*a* to provide front and rear legs 142 and 143 that rest flat on the surface of the bottom flange 18 of drawer member 11. A bore 144 and a counterbore 145 are formed near the center of the slide-connecting portion 140 for receiving respectively therethrough the shaft 19*b* and head 19*a* of a rivet 19, as shown in FIGS. 3 and 6. The rivet 19 couples the latch 100 to the drawer member 11 by way of expansion into an associated recess 11*a*** thereon.

When the latch 100 is mounted to the drawer member 11 they move together horizontally in the sliding direction of the drawer. In its normal at rest position, the legs 142 and 143 of the latch 100 rest on the bottom flange 18 and the stop surface 133 of latch 100 is disposed adjacent to the top flange 17 of the drawer member 11 for engagement with the stopping post **15*a*. In this position, the latch 100 is locked so that the stopping post 15*a* of stopper 15 limits the longitudinal travel of drawer member 11, as shown in FIG. 2, by the phantom position 500 of the stopper 15, corresponding to the condition when the drawer is almost at its fully extended or open position. Thus, the stopper post 15*a* is engaged by the stop surface 133 to block the movement of the latch 100 and the drawer member 11 to which the latch 100 is attached. However, as discussed below, when the disconnect latch 100 is flexed downward by the depression of lever 120 in the direction of the arrow in FIG. 2, the stop surface 133 will clear the stopping post 15*a* and enable the drawer member 11 together with the drawer to move past the stopper 15 and thus past the longitudinal outer edge of the intermediate slider member 12 to facilitate removal of the drawer. Such a flexed position of the latch 100 is shown by the phantom position 600** in FIG. 2.

Thus, when applying finger pressure to the lever 120 depressing it toward the bottom flange 18, the flexural main body 130 of the latch 100 will respond by flexing in the direction of the lever's depression. At the same time, the slide-connecting portion 140 will press against the bottom flange 18, without pivoting, to provide the necessary reaction while flexing the lever 120 down. Stop surface 133 will then clear the post 15*a* to enable removal of the drawer member 11.

The thickness of the latch 100 is limited by the space immediately between the side wall of the drawer member 11 and the stopper 15. The latch 100 is secured to the drawer member 11 using a fastener, such as the rivet 19 shown in FIG. 6, both ends of which are shown flush with the associated surfaces of the latch 100 and drawer member 11 to maximize the thickness of the latch 100. Alternatively, the latch 100 may be provided with an extruded post 146 formed integral with the latch 100 and secured to the drawer member 11 by way of a tab 147 extending laterally from the edge of the post 146, as shown in FIG. 7.

The use of grooves 131, 132 results in the absorption of the shock energy created by the impact of the stop surface 133 against the stopping post 15*a* on stopper 15. Under impact load, the grooves 131, 132 are laterally narrowed, i.e., compressed, to dissipate the load from the impact.

Similarly, when the lever 120 is depressed in the direction of the arrow in FIG. 2, the grooves 131, 132 will flex with the top ends thereof expanding laterally and the bottom ends narrowing, to allow the stop surface 133 to clear the stopping post 15*a*. Because of the flexing action, the need for the slide-connecting portion 140 to pivot about the mounting connected to the drawer member 11 is eliminated. This is facilitated by the inherent resilience of the latch material as well as by the grooves 131, 132. Furthermore, once finger pressure is released from the lever 120, the lever will return to its non-flexed position under its own resilience.

In accordance with a second preferred embodiment, a latch 100' is provided as shown in FIG. 8, having grooves 131', 132' which are tilted upwardly rearwardly to provide added shock absorption. Additionally, the thickness of the stop surface 133' may be made slightly greater than the thickness of the rest of the latch 100', as shown more clearly in the plan view of FIG. 9, to further increase shock absorption and flexing.

FIG. 10 shows a latch 100" in accordance with a third preferred embodiment, showing grooves 131", 132" tilting in the opposite or forward direction.

It should be readily apparent that the present invention can be practiced in many embodiments and variations. For example, the number, size, height and position of the grooves can be selectively varied to ensure the necessary flexing and shock absorption. Also, the grooves need not be vertical. Instead they may be oriented in any number of ways without compromising the flexural properties of the latch. Furthermore, the latch can be easily adapted for use with a variety of slide assemblies and can interface with variously sized drawer members. The shape and size of the lever 120 may also be variously modified without departing from the scope of the invention.

While particular embodiments of the present invention have been shown and described, it will be appreciated by those skilled in the art that additional changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A disconnect latch for use with a drawer slide assembly, the drawer slide assembly including an elongated drawer member having an upstanding side surface, and a stopper for limiting longitudinal travel of the elongated drawer member in a direction of travel, the disconnect latch including a unitarily formed combination of:

a lever;

a mounting portion for non-pivotally coupling said disconnect latch to said elongated drawer member; and a main body portion integral at one end thereof with said lever and at an opposite end thereof with said mounting portion, said main body portion defining a wall having opposite side surfaces spaced apart by a distance and substantially parallel to the upstanding side surface of the drawer member, said main body portion including a stop surface disposed for engagement with the stopper to maintain said elongated drawer member in a locked condition, said wall including a plurality of longitudinally separated grooves each having a depth less than the distance between said side surfaces of said wall and formed in at least one of said side surfaces, each of said grooves facilitating non-pivotal flexing of said disconnect latch to allow said stop surface to clear the stopper when downward pressure is applied to the lever and to allow shock absorption during impact of said stop surface against the stopper.

2. The disconnect latch of claim 1, wherein said wall has a substantially vertical height, each of said grooves spanning the height of said wall.

3. The disconnect latch of claim 1, wherein said mounting portion comprises a mounting hole for securing the latch to the elongated drawer member using a fastener.

4. The disconnect latch of claim 3, wherein said fastener is a rivet.

5. The disconnect latch of claim 1, wherein said mounting portion includes an integrally formed extruded post for snap-coupling the disconnect latch to a recess on the elongated slide member.

6. The disconnect latch of claim 5, wherein said integrally formed extruded post is annularly shaped.

7. The disconnect latch of claim 1, wherein each of said grooves has an upper end and a lower end spaced apart by a length which is substantially perpendicular to said depth thereby when downward pressure is applied to the lever the lower end of each of said grooves is compressible and the upper end of each groove is expandable to allow the stop surface to clear the stopper, and wherein when the stop surface is impacted against the stopper the upper and lower ends of said grooves are compressible to absorb any shock of the impact, said grooves returning to their original non-impacted position when no pressure or load is applied thereto.

8. The disconnect latch of claim 1, wherein said grooves are of predetermined depth and width and spaced a fixed distance apart.

9. The disconnect latch of claim 1, wherein said mounting portion rests on a bottom flange of the drawer member to prevent pivotal rotation of said disconnect latch and to provide reaction during flexing of the latch.

10. The disconnect latch of claim 1, wherein said grooves are provided in both of said side surfaces in staggered arrangement opposite one another.

11. The disconnect latch of claim 10, wherein said grooves are substantially vertical.

12. The disconnect latch of claim 10, wherein said grooves are tilted such that they extend upwardly toward said lever.

13. The disconnect latch of claim 10, wherein said grooves are tilted such that they extend upwardly away from said lever.

14. The disconnect latch of claim 10, wherein said grooves are of predetermined depth and width and spaced a fixed distance apart.

15. The disconnect latch of claim 1, wherein said grooves are substantially vertical.

16. The disconnect latch of claim 1, wherein said grooves are tilted such that they extend upwardly toward said lever.

17. The disconnect latch of claim 1, wherein said grooves are tilted such that they extend upwardly away from said lever.

18. The disconnect latch of claim 1, wherein said stop surface is generally normal to the direction of travel of the elongated drawer member and oriented so as to be engageable against the stopper to prevent sliding movement of the elongated drawer member beyond a locked position.

19. The disconnect latch of claim 1, wherein said main body portion includes a top portion extending generally longitudinally having a front end thereof defining the stop surface and a rear end integral with said mounting portion, said top portion having a thickness greater than that of other portions of the main body portion.

20. A disconnect latch including a unitarily formed elongated body having a longitudinal first axis, said body including opposite end portions and a main body portion joining said end portions, said main body portion defining a wall having opposite side surfaces spaced apart by a thickness and having a height, with the height and the thickness respectively extending along second and third axes substantially perpendicular to each other and to said first axis, with said thickness being substantially less than said height, a stop surface on said main body portion extending above and facing one of said end portions, and a plurality of axially spaced grooves formed in at least one of said side surfaces, each of said grooves having a depth substantially less than the thickness of said wall, whereby said grooves cooperatively expand and compress during a first condition to facilitate non-pivotal flexing of said disconnect latch along the second axis and whereby said grooves cooperatively compress during a second condition to dissipate an external impact force on said stop surface.

21. The disconnect latch of claim 20, wherein each of said grooves extends the entire height of said wall.

22. The disconnect latch of claim 20, wherein said grooves are of predetermined depth and width and are equidistantly axially spaced apart.

23. The disconnect latch of claim 20, wherein said grooves extend substantially perpendicular to said axis.

24. The disconnect latch of claim 20, wherein said grooves are tilted with respect to said axis such that said grooves extend in use upwardly away from said one end portion.

25. The disconnect latch of claim 20, wherein said grooves are tilted with respect to said axis such that said grooves extend in use upwardly toward said one end portion.

26. The disconnect latch of claim 20, wherein said main body portion includes a top portion extending above said one end portion, wherein said thickness is greater at said top portion than at other portions of the main body portion, said stop surface being located on said top portion.

27. The disconnect latch of claim 20, wherein said grooves are provided on both said side surfaces in staggered arrangement opposite one another.

* * * * *